United States Patent [19]

Ishikawa et al.

[11] 4,429,650

[45] Feb. 7, 1984

[54] EXTRUDED SEWING MACHINE FRAME

[75] Inventors: Hitoshi Ishikawa, Nishio; Kimihiko Yamamoto, Nagoya; Yasuro Sugiura, Takahama, all of Japan

[73] Assignee: Aisin Seiki Kabushiki Kaisha, Aichi, Japan

[21] Appl. No.: 335,494

[22] Filed: Dec. 30, 1981

[30] Foreign Application Priority Data

Jan. 14, 1981 [JP] Japan ..... 56-003667

[51] Int. Cl.[3] ..... D05B 73/00

[52] U.S. Cl. ..... 112/258

[58] Field of Search ..... 49/504; 112/258, 259; D15/76

[56] References Cited

U.S. PATENT DOCUMENTS 3,783,559 1/1974 Yocum et al. ..... 49/504

FOREIGN PATENT DOCUMENTS 2312587 5/1973 France ..... 112/259

1481366 7/1977 United Kingdom ..... 112/259

*Primary Examiner*—Werner H. Schroeder
*Assistant Examiner*—Andrew M. Falik
*Attorney, Agent, or Firm*—Sughrue, Mion, Zinn, Macpeak, and Seas

[57] ABSTRACT

A sewing machine frame is comprised of a vertical support member, a horizontal arm, and a horizontal cantilevered base member, each of which is comprised of a hollow, rectilinear aluminum extrusion. The vertical support member is secured to a horizontally disposed base and the arm and bed may be secured to a side of the vertical support member or the vertical support member may be divided into first and second portions with the first portion interposed between the arm and the bed and the second portion being interposed between the bed and the base. In the latter construction, common bolts secure the arm, the bed, the base, and the first and second portions of the vertical support member together as a unitary assembly.

4 Claims, 2 Drawing Figures

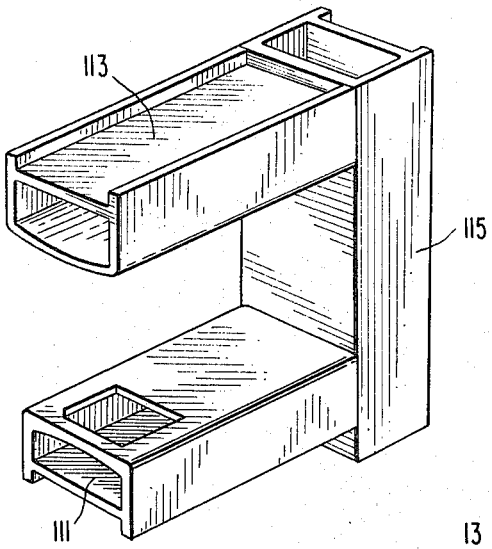
FIG. 2
FIG. 1
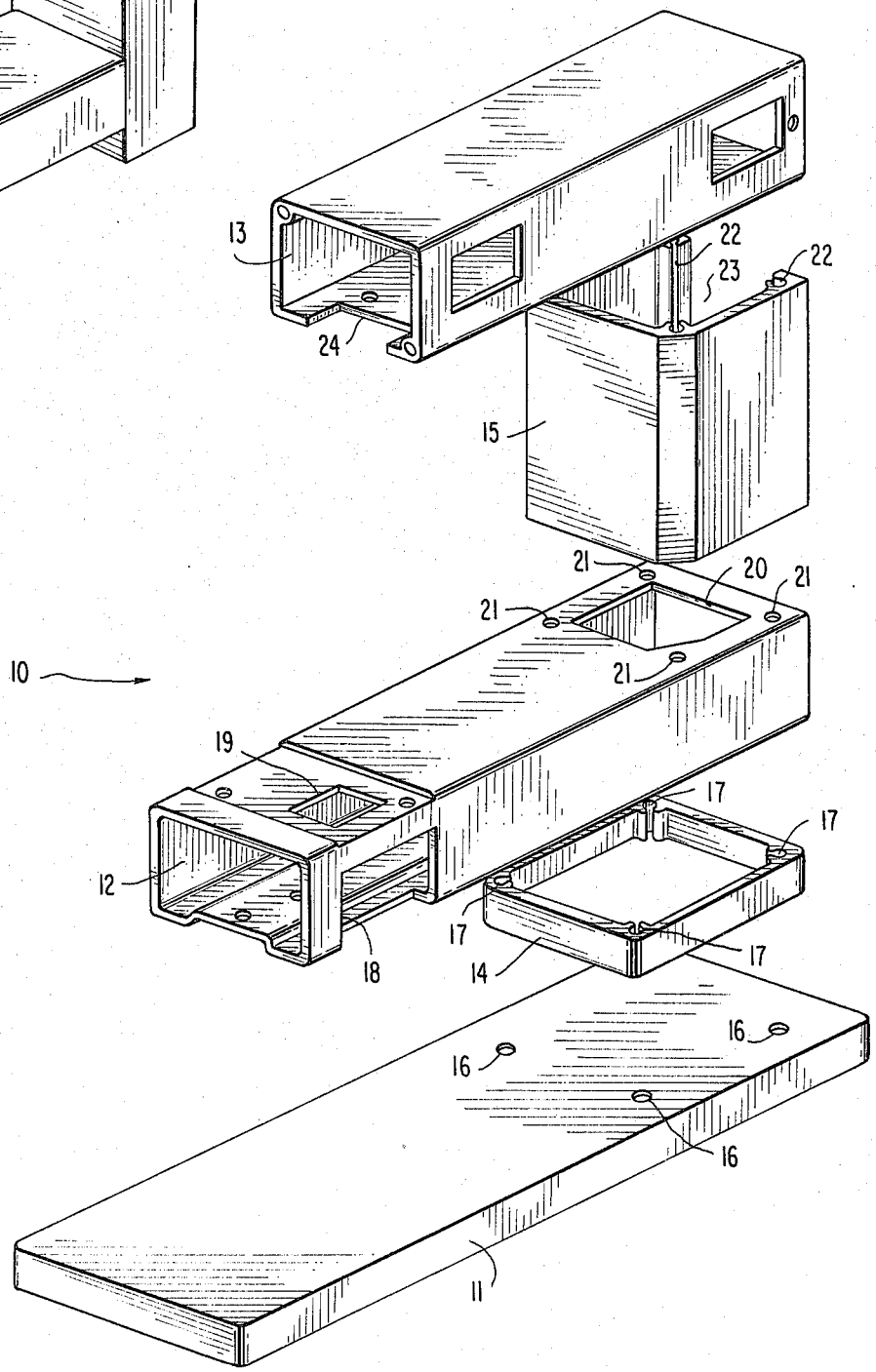

EXTRUDED SEWING MACHINE FRAME

BACKGROUND OF THE INVENTION

1. Field of the Invention:

The present invention relates to a frame of a sewing machine.

More specifically, the present invention relates to a frame composed of a plurality of hollow extruded components and the means for interconnecting the components.

2. Description of the Prior Art

A conventional frame of a sewing machine is manufactured by die casting. However, each die is complex in construction, with the result being that it is expensive to produce each die. In addition, each die cast member has to be worked and coated, thereby increasing time and cost for producing the frame.

SUMMARY OF THE INVENTION

It is, therefore, an object of this invention to provide a frame of a sewing machine without the aforementioned drawbacks.

A further object of the present invention is to provide a sewing machine frame comprised completely of hollow extrusions including a vertical support member, a cantilevered bed secured to the veritical support member and a cantilevered arm secured to the vertical support member in sapced parallel relation to said bed. The arm and the bed may be secured to the side of the vertical support member by suitable means or the vertical support member may be divided into a first support member interposed between the bed and the base member in alignment with the support member. Common means are provided for connecting said arm, said support member, said bed, said spacer and said base in assembled unitary relation to each other.

BRIEF DESCRIPTION OF THE DRAWINGS

FIG. 1 is an perspective view of a frame of a sewing machine according to an embodiment of this invention, and FIG. 2 is an exploded perspective view of a frame of a sewing machine according to another embodiment of this invention.

DETAILED DESCRIPTION OF THE PREFERRED EMBODIMENT

Referring now to FIG. 1, a frame 10 of a sewing machine includes a base 11, a cantilevered bed 12, and arm 13, a spacer 14 interposed between the base 11 and the bed 12, and a vertical support member 15 interposed between the bed 12 and the 13, all of which are manufactured by extrusion.

Four holes 16 (only one is not shown) are formed after extrusion of the base 11. Four channels 17 are formed during extrusion of the spacer 14. Windows 18, 19 and 20, and four holes 21 are formed after extrusion of the bed 12. Four channels 22 (only one is not shown) are formed in the support 15 during extrusion thereof. A notch 24 formed in the bottom surface of the arm 13 is adapted to be aligned with an unillustrated frame component. Four holes (not shown) adapted to be aligned with said channels 22 are also located on said bottom arm surface after extrusion thereof. Four bolts (not shown) are adapted to be passed through these holes in addition to the holes 16, channels 17, holes 21, and channels 22 thereby constructing the frame 10.

The frame 10 may also be formed as shown in FIG. 2 wherein the right hand sides of a base 111 and an arm 113 are connected to a support 115. Said components are formed from extruded aluminum. Support member 115 may be connected to a base similar to the base 11 in FIG. 1.

What is claimed is:

1. A sewing machine frame composed of a plurality of hollow extruded components comprising a vertical support member comprised of hollow extrusion means, a horizontal cantilevered bed comprised of hollow extrusion means connected to said support member, a horizontally disposed arm comprised of hollow extrusion means connected to said support member in spaced parallel relation to said bed and a base member connected to said support member.

2. A sewing machine frame as set forth in claim 1 wherein said arm and said bed are each connected at one end to a side of said vertical support member.

3. A sewing machine frame as set forth in claim 1 wherein said vertical support member is comprised of a first portion interposed between said and said bed and a second portion interposed between said bed and said base, said first and second portions being disposed in vertical alignment with each other and further comprising common connecting means securing said arm, said first portion, said bed, said second portion, and said base in unitary assembled relation to each other.

4. A sewing machine frame as set forth in claim 1 wherein said hollow extrusion means are comprised of hollow rectilinear aluminum extrusions.

* * * * *